US006588739B1

(12) United States Patent
Weis

(10) Patent No.: US 6,588,739 B1
(45) Date of Patent: Jul. 8, 2003

(54) DEVICE FOR FEEDING A WEB OF MATERIAL INTO A FOLDING MACHINE

(75) Inventor: Anton Weis, Lorsch (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/856,472

(22) PCT Filed: Nov. 5, 1999

(86) PCT No.: PCT/DE99/03537

§ 371 (c)(1),
(2), (4) Date: Jun. 8, 2001

(87) PCT Pub. No.: WO00/34167

PCT Pub. Date: Jun. 15, 2000

(30) Foreign Application Priority Data

Dec. 8, 1998 (DE) ..... 198 56 422

(51) Int. Cl.[7] ..... B41F 13/58

(52) U.S. Cl. ..... 270/6; 270/41; 270/43; 493/358

(58) Field of Search ..... 270/5.01, 5.02, 270/5.03, 6–9, 21.1, 41, 42, 43; 493/346, 429, 433, 440, 357, 358, 359, 360, 361, 479

(56) References Cited

U.S. PATENT DOCUMENTS 3,819,172 A * 6/1974 Santaella ..... 270/41
3,977,665 A * 8/1976 Bowman et al. ..... 270/21.1
4,349,185 A * 9/1982 Small et al. ..... 270/42
4,691,908 A * 9/1987 Bradley ..... 270/214
4,725,050 A 2/1988 Fujishiro
5,303,909 A 4/1994 Maylaender
5,503,379 A * 4/1996 Michalik et al. ..... 270/41
5,573,231 A * 11/1996 Stab ..... 270/43
5,685,528 A 11/1997 Weis
5,707,054 A * 1/1998 Loquet et al. ..... 270/6
5,775,222 A 7/1998 Zweifel et al.
6,010,122 A * 1/2000 Weber ..... 270/41
6,024,684 A * 2/2000 Mayländer et al. ..... 493/346
6,193,640 B1 2/2001 Weis

FOREIGN PATENT DOCUMENTS

DE 2435972 C2 5/1983
DE 9421467 U1 1/1996
DE 29617976 U1 2/1997

* cited by examiner

*Primary Examiner*—Eugene H. Eickholt
(74) *Attorney, Agent, or Firm*—James, Tullar & Cooper, PC

(57) ABSTRACT

A device for feeding a web of material utilizes a pair of low angle bar superstructures situated adjacent to each other. Two cross or transverse folding devices are situated on the same or on different planes after, in the direction of web travel, the superstructures. Wide webs of material can be processed and if one of the transverse folders fails, production can be shifted to the other folder.

7 Claims, 2 Drawing Sheets

DEVICE FOR FEEDING A WEB OF MATERIAL INTO A FOLDING MACHINE

Figure 1:
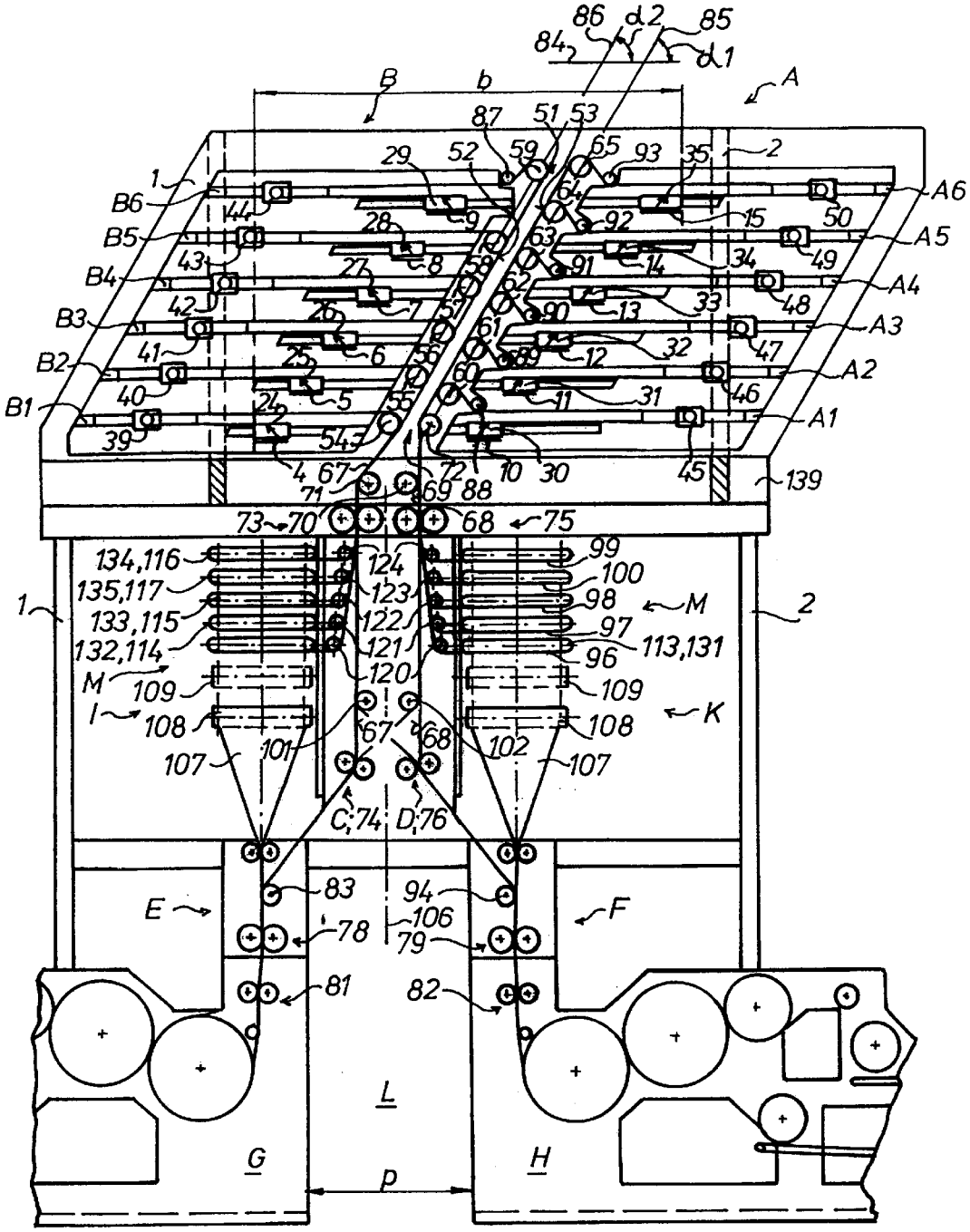

The invention relates to a feeding device for a web of material in accordance with the preamble of claim 1.

Paper web feeding devices consisting of a first and second superstructure, between which an unencumbered connecting partial paper web guide chute, which is bordered by paper guide rollers, is arranged, are known from DE 94 21 467 U1. A longitudinal folding device for so-called "funnel production", or a draw-in device for so-called "magazine production", are selectively provided between the superstructures and a web inlet of the folding device, or of the transverse folding device.

DE 296 17 976 U1 discloses a feeding device for a web of material for two folding devices, wherein two superstructures are arranged one above the other.

The object of the invention is based on providing a feeding device for a web of material for a folding device.

The object is attained in accordance with the invention by the means of the characteristics of claim 1.

The following advantages in particular are achieved by means of the invention: only short paths are needed for guiding the partial webs of material because of the guidance of two partial webs of material on a horizontal level of the two-part superstructure and using respectively only one turning bar. A low structural height of the superstructure is achieved in this way which, in turn, leads to the reduction of the total height of the web-fed rotary printing press. The number of production variations is increased by the use of two transverse folding devices. The ability to vary the products is increased by means of the selective use of two arranged longitudinal folding devices, or of two arranged draw-in devices for funnel production or for magazine production, along with a low structural height of the two-piece compact superstructure, which exists anyway.

A reduced technical outlay also occurs because the feeding device for the webs of material can be used for both types of production mentioned above. It is advantageously possible to process wide webs of material with two transverse folding devices.

With an arrangement of two transverse folding devices oriented in the same direction it is possible in case of the outage of a first transverse folding device to provide a replacement function, without changing the plate on the printing cylinder, by using the second transverse folding device.

Exemplary embodiments of the invention are represented in the drawings and will be described in greater detail in what follows.

Figure 2:
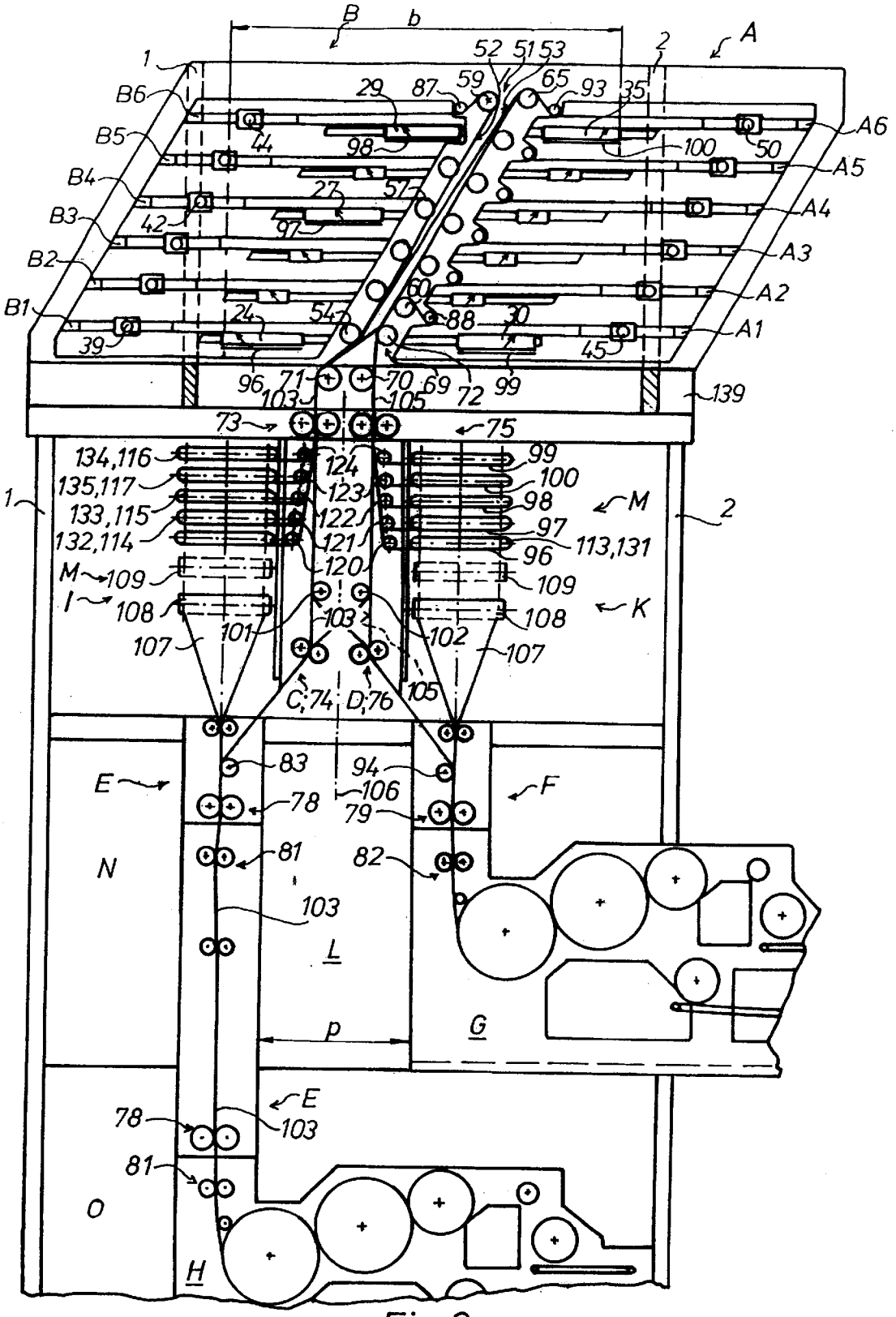

Shown are in:

FIG. 1, a schematic plan view of feeding device for webs of material for two folding devices, selectively for funnel production or magazine production, wherein the folding devices are arranged on a common level, FIG. 2, a schematic plan view analogous to FIG. 1, but with two folding devices arranged on different levels.

A web of material, for example a printed paper web as wide as a printing cylinder and of a width b, enters a known longitudinal cutting device, not represented, from print units, not represented, of a web-fed rotary printing press, for example a web-fed rotogravure rotary printing press arranged between lateral frames 1 and 2, for example, where the paper web is longitudinally cut into twelve partial paper webs 4 to 15, for example. The partial paper webs 4 to 15 are conducted to a first superstructure A connected with the lateral frames 1, 2, as well as to a second superstructure B, in which respective partial paper web guide groups A1 to A6, as well as B1 to B6, are arranged above each other for guiding and diverting the partial paper webs 4 to 15. Here, respectively two partial paper webs 4, 10; 5, 11; 6, 12; 7, 13; 8, 14; 9, 15 are arranged on horizontally extending levels B1, A1; B2, A2; B3, A3; B4, A4; B5, A5; B6, A6, with respectively five intervening spaces of a partial paper web width. Each one of the said partial paper web guide groups A1 to A6, as well as B1 to B6 has one of the turning bars 24 to 35, one of the register rollers 39 to 50, as well as one of the guide rollers 54 to 65. The partial paper webs 4 to 9 of the superstructure B, or 10 to 15 of the superstructure A, which are each turned by 90° over the turning bars 24 to 35 and are guided in the horizontal direction, are conducted in the direction of the respective lateral frames 1, or 2, and are subsequently conducted back via the respective register rollers 39 to 44, or 45 to 50, which are adjustable in the horizontal direction, in the superstructures A, B, and toward each other in pairs 4, 10; 5, 11; 6, 12; 7, 13; 8, 14; 9, 15 in the partial paper guide groups B1 to B6, as well as A1 to A6, to a connecting partial paper web guide chute 51, on whose two chute sides 52, 53 the guide rollers 54 to 65, which are fixed in place in the lateral frames, are respectively provided per partial paper web guide group B1 to B6, as well as A1 to A6, for the vertical diversion of the partial paper webs 4 to 15. The guide rollers 54 to 65 are each embodied as separately driven draw rollers, but are called guide rollers in the following description. Thus, guide rollers, register rollers, as well as a plurality of turning bars, for example two turning bars, are arranged on each level A1, B1 to A6, B6. In this case, the partial paper webs 4 to 9, which are conducted at the first chute side 52 over the guide rollers 54 to 59 are combined into a first partial paper web strand 67, and the partial paper webs 10 to 15, which are conducted at the second chute side 53 over the guide rollers 60 to 65, are combined into a second partial paper web strand 68.

The two partial paper web strands 67, 68 are each conducted at the lower end 69 of the partial paper web guide chute 51 over guide rollers 71, 72, fixed in the lateral frames, and over pairs of draw rollers 73, 75 to draw units C, D located on a machine level underneath the superstructures A, B.

Each one of the draw units C, D is used for "magazine production" and consists of a pair of draw rollers 74, 76.

The pairs of draw rollers 74, 75 are spaced apart from each other at least horizontally, and can be located in separate lateral frames, not represented. Each one of the draw units. C, D is respectively located on a level above a strand inlet E, or F, of two transverse folding units G, H located on the lowest level L (FIG. 1).

The transverse folding units G, H located on a common level are placed "back to back", and their delivery belts each point in opposite directions (FIG. 1). It is also possible for the transverse folding units G, H to be arranged one behind the other, and for their delivery belts to point in the same direction. Finally, it is possible to arrange both transverse folding units G, H next to each other in the axial direction.

The transverse folding units G, H can be embodied as so-called jaw folders or as so-called wheel folders.

The strand inlet E, F of each transverse folding unit G, H consists of a pair of draw rollers 78, 79 for drawing in one of the two partial paper web strands 67, 68, as well as of a known transverse strand cutting device 81, 82 of the transverse cutting unit G. H.

All shafts, or axes, of the register rollers 39 to 50, as well as of the guide rollers 54 to 60, the guide rollers 71, 72, of the rollers of the strand inlets E, F, as well as of the transverse strand cutting device 81, 82, extend with their axes parallel to each other and at right angles to the shafts, or axes, of the print units of the web-fed rotary printing press.

The partial paper web guide chute 51, which separates the two superstructures A, B to form the partial paper web strands 67, 68 receives the guide rollers 54 to 59, as well as 60 to 65, which are arranged above each other on its chute sides 52, 53, of the superstructures B, A, wherein the guide rollers 54 to 59 of the superstructure B are located on a level 86, and the guide rollers 60 to 65 of the superstructure A are located on a level 85. Both levels 85, 86 intersect a horizontal line 84 at an acute angle alpha 1, alpha 2, and can extend parallel with each other. Viewed in the running direction of the partial paper webs 9 to 15, a paper guide roller 87 to 89 is respectively arranged ahead of the guide rollers 59 to 65 in order to achieve an improved looping of the paper web around the associated guide rollers 59 to 65.

When operating as a "magazine production", the operation of the paper web feeding underneath the superstructures A, B is as follows: coming from the pair of draw rollers 73, the first partial paper web strand 67 runs through the left draw unit C and can be introduced over a paper guide roller 83 into the left strand inlet E of the left transverse folding unit G.

In the same way it is possible, to conduct the second partial paper web strand 68 coming from the pair of draw rollers 75 over the right draw unit D and a paper guide roller 94 into the right strand inlet F to the right transverse folding unit H.

However, it is also possible to assign the left partial paper web strand 67 via a paper guide roller 101 to the right draw unit D, and therefore to the strand inlet F and the right transverse folding unit H.

Moreover, the second partial paper web strand 68 can be assigned via a paper guide roller 102 to follow the left strand inlet E, and therefore to the left transverse folding unit G.

It is of course also possible to operate as a so-called "funnel production" with the configuration of the paper feeding device represented in FIG. 1, which is performed analogously to the remarks regarding FIG. 2. In this case the partial paper webs 4 to 15 are conducted over the funnel inlet group M of the longitudinal folding units I, K.

In case it is intended to operate as a so-called "funnel production", i.e. longitudinally folded partial paper web strands are produced from wider partial paper webs, which are subsequently intended to be transversely cut and transversely folded, then in accordance with FIG. 2 a printed paper web, for example of the width of a printing cylinder, of a width b is longitudinally cut into, for example, five partial paper webs 96 to 100 of equal width. The partial paper webs 96 to 100 are conducted to the superstructures A, B (same parts have the same reference numerals), wherein the partial paper webs 96, 97, 98 are turned on the turning bars 24, 27, 29 in the partial paper web guide groups B1, B4, B6 on the left side of the partial paper web guide chute 51 and are horizontally guided, and the partial paper webs 99, 100 are turned on the turning bars 30, 35 in the partial paper web guide groups A1, A6 on the right side of the partial paper web guide chute 51 and, as already described above, are conducted in an approximately vertical direction to the lower end 69 of the partial paper web guide chute 51. In the process, a common paper web strand 103 is formed, which is conducted over a guide roller 71 to a left longitudinal folding unit I located on a machine level underneath the superstructures A, B.

It would also be possible, to provide a right partial paper web strand 105, constituted by the partial paper webs 100 and 99, over the guide roller 72 to a right longitudinal folding unit K, which is located on the same level as the left longitudinal folding unit I.

Finally, it is also possible to conduct the paper web strand 103 coming out of the two superstructures A, B to the right longitudinal folding unit K.

The two longitudinal folding units I, K are arranged mirror-inverted in respect to a level 106 extending between them, and are therefore provided with the same reference numerals.

Each longitudinal folding unit I, K consists of a known longitudinal folding funnel 107 with two pairs of funnel inlet rollers 108, 109 arranged above it, only one roller of which is shown. The elements 107, 108, 109 of the longitudinal folding unit I, K are located in a separate frame, not represented. The frame also receives a funnel inlet group M respectively located above the longitudinal folding units I, K, and consists of five turning bars 113 to 117 arranged above each other. Five paper guide rollers 120 to 124, which are fixed in place in the frame and extend axis-parallel with the guide roller 71, are arranged upstream of the turning bars 113 to 117 on the same horizontal level, and paper guide rollers 131 to 135, located on the same horizontal level, are arranged downstream from them. In this way the partial paper webs 96 to 100, which are fed in from the superstructure A, B as a paper web strand 103, are separately conducted by the paper guide rollers 120 to 124 of the funnel inlet group M of the longitudinal folding unit I through 90° from the vertical into a horizontal direction, turned by means of the turning bars 113 to 117, and are conducted to the longitudinal folding unit I over the following paper guide rollers 131 to 135 through 90° in a vertical direction, which is offset by 90° in respect to the first vertical direction.

Thereafter, the longitudinally folded paper web strand 103 is conducted to the transverse folding unit H located on the lowest level C for further processing, after the longitudinally folded paper web strand 103 has passed over the pair of draw rollers 78 located upstream of the transverse folding unit H (FIG. 2).

The two transverse folding units G, H are arranged on different horizontal levels O, N, wherein the level N with the transverse folding unit G is located above the level O. Here, the strand inlets E, F are each offset and distant from each other at a distance p.

In this case the delivery belts for the printed products are pointing in the same direction. Because of this it is possible that both transverse folding devices G, H can be operated separately or, when one of the transverse folding devices G or H fails, its production can be taken over by the other transverse folding device. List of Reference Numbers

| | |
|---|---|
| 1 | Lateral frame |
| 2 | Lateral frame |
| 3 | — |
| 4 to 15 | Partial paper webs |
| 10 to 23 | — |
| 24 to 35 | Turning bar (A, B) |
| 36 | — |
| 37 | — |
| 38 | — |
| 39 to 50 | Register roller (A, B) |
| 51 | Partial paper web guide chute |
| 52 | Chute side, first (51) |
| 53 | Chute side, second (51) |

-continued

| | |
|---|---|
| 64 to 65 | Guide roller (A, B) |
| 66 | — |
| 67 | Partial paper web strand, first |
| 68 | Partial paper web strand, second |
| 69 | End, lower (51) |
| 70 | — |
| 71 | Guide roller |
| 72 | Guide roller |
| 73 | Pair of draw rollers (67) |
| 74 | Pair of draw rollers, left |
| 75 | Pair of draw rollers (68) |
| 76 | Pair of draw rollers, right |
| 77 | — |
| 78 | Pair of draw rollers (E) |
| 79 | Pair of draw rollers (F) |
| 80 | — |
| 81 | Transverse strand cutting device (G) |
| 82 | Transverse strand cutting device (H) |
| 83 | Paper guide roller |
| 84 | Horizontal line |
| 85 | Level (60 to 65) |
| 86 | Level (54 to 59) |
| 87 to 93 | Paper guide roller |
| 94 | Paper guide roller |
| 95 | — |
| 96 to 100 | Partial paper webs |
| 101 | Paper guide web |
| 102 | Paper guide web |
| 103 | Paper web strand, left |
| 104 | — |
| 105 | Paper web strand, right |
| 106 | Level (I, K) |
| 107 | Longitudinal folding funnel |
| 108 | Pair of funnel inlet rollers (F) |
| 109 | Pair of funnel inlet rollers (F) |
| 110 | — |
| 111 | — |
| 112 | — |
| 113 | Turning bar (I, K, 96) |
| 114 | Turning bar (I, K, 97) |
| 115 | Turning bar (I, K, 98) |
| 116 | Turning bar (I, K, 99) |
| 117 | Turning bar (I, K, 100) |
| 118 | — |
| 119 | — |
| 120 | Paper guide roller (I, K, 96) |
| 121 | Paper guide roller (I, K, 97) |
| 122 | Paper guide roller (I, K, 98) |
| 123 | Paper guide roller (I, K, 99) |
| 124 | Paper guide roller (I, K, 100) |
| 125 to 130 | |
| 131 to 135 | Paper guide roller |
| A | Superstructure, first |
| B | Superstructure, second |
| C | Draw unit (74) |
| D | Draw unit (75) |
| E | Strand inlet |
| F | Strand inlet |
| G | Transverse folding unit |
| H | Transverse folding unit |
| I | Longitudinal folding unit, left |
| K | Longitudinal folding unit, right |
| L | Level |
| M | Funnel inlet group (I, K) |

-continued

| | |
|---|---|
| N | Level |
| O | Level |
| A1 to A6 | Partial paper web guide groups |
| B1 to B6 | Partial paper web guide groups |
| b | Width of paper web |
| p | Distance (G, H) |
| alpha 1 | Angle (84, 85) |
| alpha 2 | Angle (84, 85) |

What is claimed is:

1. A material web feeding device for a folding unit comprising:

a first superstructure having a plurality of first superstructure levels and a second superstructure having a plurality of second superstructure levels, said first and second superstructures being arranged next to each other;

a plurality of turning bars and guide rollers arranged on each of said first and second superstructure levels;

an unencumbered connecting guide chute for receiving several partial webs of material, said guide chute being positioned between said turning bars on each of said first and second superstructure levels;

a plurality of transverse folding units adapted to process the partial webs of material, said transverse folding units being located after, in a direction of travel of the partial webs of material, said first and second superstructures, each of said plurality of transverse folding units having a delivery belt, said delivery belts of said plurality of transverse folding units pointing in the same direction, said plurality of transverse folding units each being separated arranged on a different level; and a plurality of longitudinal folding units and a plurality of draw units arranged intermediate said first and second superstructures and said plurality of transverse folding units.

2. The material web feeding device of claim 1 wherein said guide rollers are driven draw rollers.

3. The material web feeding device of claim 1 further including register rollers on each of said plurality of first and second superstructure levels.

4. The material web feeding device of claim 1 wherein an even number of said turning bars is provided on each of said first and second superstructure levels.

5. The material web feeding device of claim 1 wherein two of said turning bars are provided on each of said first and second superstructure levels.

6. The material web feeding device of claim 1 wherein each of said transverse folding units is a jaw folder.

7. The material web feeding device of claim 1 wherein each of said transverse folding units is a wheel folder.

* * * * *